United States Patent [19]

Svoboda

[11] 4,349,212

[45] Sep. 14, 1982

[54] HOLDING PLATE, IN PARTICULAR FOR SKI BINDINGS

[75] Inventor: Josef Svoboda, Schwechat, Austria

[73] Assignee: TMC Corporation, Baar, Switzerland

[21] Appl. No.: 70,290

[22] Filed: Aug. 28, 1979

[30] Foreign Application Priority Data

Aug. 28, 1978 [AT] Austria ..... 6255/78

[51] Int. Cl.[3] ..... A63C 5/00

[52] U.S. Cl. ..... 280/610; 280/612; 280/816

[58] Field of Search ..... 280/611, 612, 602, 601, 280/12 A, 809

[56] References Cited

U.S. PATENT DOCUMENTS

| | | | |
|---|---|---|---|
| 3,762,735 | 10/1973 | Smolka | 280/612 |
| 3,819,199 | 6/1974 | Smolka | 280/612 |

FOREIGN PATENT DOCUMENTS

| | | | |
|---|---|---|---|
| 1913404 | 10/1970 | Fed. Rep. of Germany | 280/612 |
| 2658087 | 7/1978 | Fed. Rep. of Germany | 280/601 |
| 927897 | 5/1947 | France | 280/602 |

*Primary Examiner*—Joseph F. Peters, Jr.

*Assistant Examiner*—Donald W. Underwood

*Attorney, Agent, or Firm*—Blanchard, Flynn, Thiel, Boutell & Tanis

[57] ABSTRACT

A circuit arrangement embodied within the construction of a ski. A conductor plate is provided inside the ski and has at least one threaded opening therein for threadedly receiving a screw which facilitates a fastening of a base plate for a ski binding member to the upper surface of the ski. The screw is threadedly received in the opening and the base plate of the ski binding member is clamped between the head of the screw and the upper surface of the ski. The screw is electrically insulated from the base plate of the ski binding member but does provide a metal-to-metal contact with the conductor plate. The base plate of the ski binding member and the conductor plate are electrically conductive so that these two plates can function as components of an electrical circuit embodied within the ski. A battery can be mounted within the ski and the aforementioned base plate and conductor plate utilized in circuit with the battery to provide power to electrical loads located elsewhere on the ski, as for example in the ski binding members.

6 Claims, 3 Drawing Figures

HOLDING PLATE, IN PARTICULAR FOR SKI BINDINGS

FIELD OF THE INVENTION

The invention relates to a circuit arrangement or circuit for operating at least one electrical load which is provided on or in a ski, preferably on a ski binding part and which is fed by a current source, for example by a battery, in particular a signal transmitter.

BACKGROUND OF THE INVENTION

A holding plate for ski bindings is described in Austrian Pat. No. 114 326. According to this reference, it is already known to insert into the mass which forms the ski, which consists partially or totally of a plastic material for fastening of ski bindings on skis, a reinforcing plate, which serves as a base for the ski binding part which must be fastened to the ski. Similar inserts have later also become known in skis which consist of layers. It is thereby of no importance to which degree the individual layers consist of a plastic or of a nonmetal, since said layers are not sufficient for receiving screws therethrough to effect a holding of the ski binding parts to the ski.

Also various solutions are known which use for the release of a locking member in a ski binding part an electrically or electronically controlled impulse. For example, reference is made to German OS Nos. 2 139 557, 1 578 949, 1 578 974, 2 244 949 and Austrian Pat. No. 337 058. According to German OS No. 2 748 309, it is further known to use for detecting the loads, calculating and releasing of the binding, at least one primary electric circuit and in at least one additional circuit a device for producing an electric signal. In all of these conventional solutions, circuits are suggested which are sufficiently complicated for ski binding design due to the structure thereof, that such solutions up to now could practically not be sold on the market.

The purpose of the invention is to provide assistance here and a circuit arrangement or a circuit which results in a maintenance-free and watertight solution, which is also protected against external damage and is thereby economical in operation utilizing thereby partly and if desired structural parts which are already existing in the ski.

The set purpose is inventively attained by providing a circuit arrangement for facilitating an operation of at least one electrical load, in particular a signal transmitter, provided on a ski and which is fed by current from a current source, such as a battery. At least one plate is provided in the body of the ski and serves as an electrical conductor for the circuit arrangement. The conductor plate also serves as an anchor to which is secured the ski binding members.

Due to the fact that at least as one of the electric conductors of the circuit arrangement or of the circuit there is used a base plate which is provided in the body of the ski, the set goals are reached in a simple and inexpensive manner. The use of base plates which are provided in the body of the ski permits the electrical connection between two or more separate loads provided in the binding parts in or on the ski to be used as an impulse or signal transmitter in a conventional manner for operating of ski binding parts (release operation) and/or for indicating various conditions of the respective structural parts. Of course, it is to be understood that said structural parts may not only be ski bindings, but any desired other devices, for example ski brakes, ski locks, climbing aids and others.

BRIEF DESCRIPTION OF THE DRAWING

Further characteristics, details and advantages of the invention will be described more in detail with reference to the drawing, in which two exemplary embodiments are illustrated.

In the drawing.

DETAILED DESCRIPTION

Figure 1:
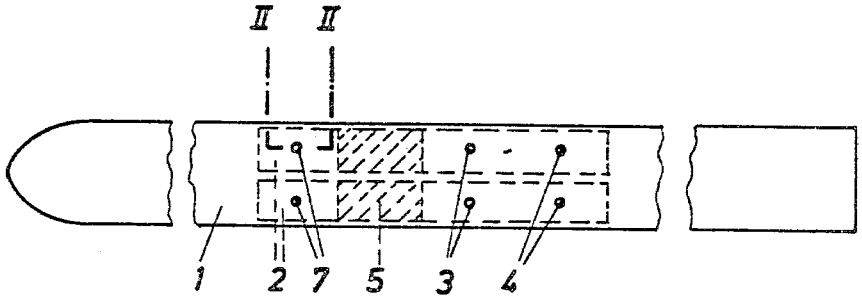
FIG. 1 is a top view of a ski having two conductor plates arranged parallel to one another.

Inside of a ski 1, according to FIG. 1, approximately below the region of the ski binding parts, which are not illustrated, there are provided two side-by-side lying conductor plates 2 each having an identical rectangular shape. Each of the two conductor plates 2 has in the region of each of the ends closest to the tip of the ski an opening 7. In the region of the end which is remote from the tip of the ski, each of the two conductor plates 2 have two openings 3, 4 spaced axially along the ski. The two openings 3, 4 which are associated with each conductor plate 2, viewed in the longitudinal direction of the ski 1, are spaced from one another; and are in alignment—viewed at a right angle with respect to the longitudinal axis of the ski 1—with the openings 3, 4 of the other conductor plate 2. Between the front openings 7 and the rear openings 3, 4, each of the two conductor plates 2 carries printed circuits and/or electronic elements 5 or the plates are each provided with such circuits and/or elements. Mounting of the electronic elements 5 inside of the ski 1 on the or rather in the current-conducting conductor plates 2 does not only bring about the advantage that no additional structural parts and lines must be mounted on the ski 1, but aside from the compact arrangement also an additional protection against damage of said structural parts exists.

Figure 2:
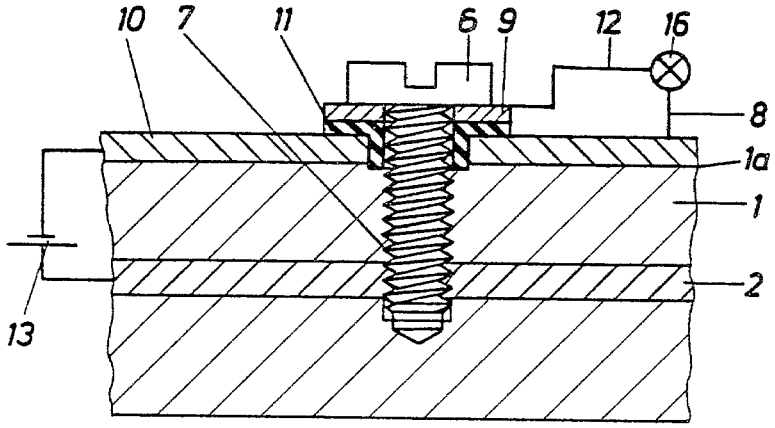
FIG. 2 is a cross-sectional view of a detail for fastening of a screw in one of the conductor plates taken along the line II—II of FIG. 1.

FIG. 2 illustrates a detail of FIG. 1, particularly of a screw 6, which serves to secure the base plate 10 of a ski binding part, not shown, to the ski and to the plate 2 wherein for a better understanding, the connection of a battery 13, which serves as a current source, is also indicated. To receive the screw 6, the ski 1 has a threaded hole 7 therein designed sufficiently long that it extends through the conductor plate 2 and slightly projects beyond same. Thus, the screw 6 which is threadedly received in the hole 7 creates a metal-to-metal connection with the conductor plate 2. The base plate 10 of the ski binding part will be recognized as being provided on the upper surface of the ski 1*a* and is secured to the upper surface by means of the screw 6. A cylindrical insulator 11 having a radial flange at one end is provided between the screw 6 and the base plate 10 with the interpositioning of a washer 9 between the base plate 10 and the radial flange on the insulator. The insulator 11 isolates the screw 6 and the washer 9 from the base plate 10 in an electric sense, however, does not change the holding function of the screw 6. The outside diameter of the radial flange on the insulator 11 corresponds thereby approximately with the diameter of the washer 9, the diameter of which in turn is larger than the diameter of the head of the screw 6. Thus a perfect insulation of the screw 6 from the base plate 10 is effected. The base plate 10 is electrically connected to one pole of the battery 13 and the conductor plate 2 is electrically connected to the other pole of the battery. An electrical load 16 is connected by means of a conductor 12 through the washer 9 and screw 6 to one pole of the battery 13 and by means of a different line 8 to the other part of the circuit, namely, the other pole of the battery. In the present exemplary embodiment, the conductor plates 2 and the line 12 form the positive conductor and the base plate 10 and the other line 8 form the negative conductor.

Figure 3:
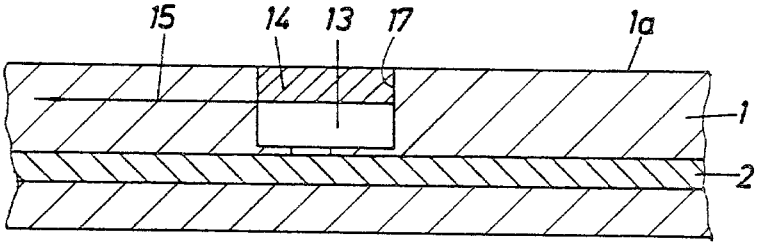
FIG. 3 is also a cross-sectional view of a different exemplary embodiment having a battery built into the body of the ski.

In the exemplary embodiment which is illustrated in FIG. 3, there is illustrated an arrangement of the battery 13 which functions as a current source. The battery 13 is arranged in a recess 17 of the ski 1, which recess 17 is, viewed in a side elevational direction, provided between the plane of the conductor plates 2 and the upper surface 1*a* of the ski. The battery 13 has one electrical contact surface 14 which terminates flush with the upper surface 1*a* of the ski, on which surface rests the base plate 10 thereby forming an electric contact. A schematically illustrated cable 15, which is also arranged in the body of the ski 1 leads to an electric load (not illustrated) as, for example, the toe binding component of the surface 14 is electrically connected to the heel binding component. The connection of the ski binding part corresponds with what was described above. It is to be understood that, if necessary, one or several switches can be used, the construction and installation of which should be known to the man skilled in the art without further discussions.

The most important advantage of the inventive construction consists in being able to use the reinforcing structural parts which exist as anchor plates at the same time as conductor plates for the transmission of electric current, wherein for the transmission of electrical power, short lines, cables and other devices which can be stored in the ski binding part or the like can be used, because the conduction of the current is accomplished through the conductor plates 2 which serve as connections through the screws 6 which fasten the ski binding parts and the like to the ski. Similar tasks are fulfilled by the base plates 10 of the individual ski binding parts.

The inventive arrangement can be used particularly when various electric or electronic apparatus, which checks the function of ski binding parts, ski brakes and the like are used and are protected against damage.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a ski construction having an electrically conductive base plate, an electrically operable load on a ski binding which is mounted on said base plate, a battery operatively connected to said load to provide the electrical power necessary to effect an operation of said load, the improvement comprising an electrically conductive anchor plate means embedded in said ski and being vertically spaced from and insulated from said base plate, an electrically conductive fastening means for fastening said ski binding to at least one of said base plate and said anchor plate means, said battery having a positive terminal electrically connected to one of said base plate and said anchor plate means and a negative terminal electrically connected to the other of said base plate and said anchor plate means, said load having at least first and second electrical conductors thereon, said first electrical conductor being electrically coupled to said fastening means, said second electrical conductor being electrically coupled to said other of said base plate and said anchor plate means.

2. The ski construction according to claim 1, wherein said anchor plate means is electrically connected to said load through said fastening means, said fastening means extending through a hole in said base plate and is electrically insulated with respect thereto.

3. The ski construction according to claim 2, wherein said fastening means is a fastening screw, wherein said anchor plate means has means defining at least one threaded hole therein, the axis of which extends substantially perpendicular with respect to the upper surface of said ski, into which hole is threadedly received said fastening screw to form with said anchor plate means a metal-to-metal electric contact, and wherein insulation means are provided for insulating said fastening screw from said base plate.

4. The ski construction according to claim 1, wherein said ski has a recess therein, wherein said battery is arranged in said recess, which recess, viewed in elevational direction, is constructed between the plane of said anchor plate and said upper surface of said ski, and wherein a surface of said battery terminates flush with said upper surface of said ski, on which surface rests said base plate forming an electric contact.

5. The ski construction according to claim 3, wherein said insulation means includes a cylindrical insulator having a radial flange thereon received in said hole in said base plate, the diameter of said radial flange being larger than the head of said fastening screw.

6. The ski construction according to claim 1, wherein said anchor plate means includes a pair of identical, laterally spaced anchor plates, said fastening means including at least two fastening screws extending through a hole in said base plate to an axially aligned threaded hole in said anchor plates to form an electrical contact between each said fastening screw and said anchor plate, and wherein insulation means are provided for insulating each said fastening screw from said base plate.

* * * * *